US009314658B2

(12) United States Patent
Kaye

(10) Patent No.: US 9,314,658 B2
(45) Date of Patent: Apr. 19, 2016

(54) STRENGTH TRAINING AND STRETCHING SYSTEM

(71) Applicant: ARQEX Outdoor Fitness Systems, LLC, Rye Brook, NY (US)

(72) Inventor: Eric Kaye, Rye Brook, NY (US)

(73) Assignee: ARQEX OUTDOOR FITNESS SYSTEMS, LLC, Rye Brook, NY (US)

( * ) Notice: Subject to any disclaimer, the term of this patent is extended or adjusted under 35 U.S.C. 154(b) by 105 days.

(21) Appl. No.: 13/836,359

(22) Filed: Mar. 15, 2013

(65) Prior Publication Data

US 2014/0274607 A1 Sep. 18, 2014

(51) Int. Cl.

| | |
|---|---|
| ***A63B 21/04*** | (2006.01) |
| ***A63B 21/055*** | (2006.01) |
| ***A63B 23/035*** | (2006.01) |
| ***A63B 23/12*** | (2006.01) |
| ***A63B 21/00*** | (2006.01) |
| *A63B 23/00* | (2006.01) |

(52) U.S. Cl.

CPC ..... *A63B 21/0557* (2013.01); *A63B 21/00069* (2013.01); *A63B 21/0442* (2013.01); *A63B 21/4035* (2015.10); *A63B 21/4043* (2015.10); *A63B 23/03508* (2013.01); *A63B 23/03541* (2013.01); *A63B 23/1209* (2013.01); *A63B 23/1218* (2013.01); *A63B 2023/006* (2013.01)

(58) Field of Classification Search

CPC ... A63B 21/0557; A63B 21/0552; A63B 9/00
USPC ..... 482/130, 129, 121, 92
See application file for complete search history.

(56) References Cited

U.S. PATENT DOCUMENTS

| | | | | |
|---|---|---|---|---|
| 163,957 | A | | 6/1875 | Wood |
| 509,694 | A | * | 11/1893 | Pauls et al. ..... 30/298 |
| 3,345,067 | A | | 10/1967 | Smith |
| 3,598,406 | A | * | 8/1971 | Robinson ..... 482/24 |
| 4,373,716 | A | * | 2/1983 | Pagani ..... 482/130 |
| 4,620,701 | A | | 11/1986 | Mojden |
| 4,685,670 | A | | 8/1987 | Zinkin |
| 5,039,092 | A | | 8/1991 | Olschansky et al. |
| 5,112,287 | A | | 5/1992 | Brewer |
| 5,205,803 | A | | 4/1993 | Zemitis |
| 5,211,617 | A | * | 5/1993 | Millen ..... 482/127 |
| 5,269,737 | A | | 12/1993 | Sobotka |
| 5,288,074 | A | * | 2/1994 | Scheurer ..... 473/277 |
| 5,496,246 | A | * | 3/1996 | Pierre ..... 482/130 |
| 5,499,959 | A | | 3/1996 | Holmes et al. |
| 5,626,546 | A | | 5/1997 | Little |
| 5,700,232 | A | | 12/1997 | Clausen et al. |
| 5,839,997 | A | | 11/1998 | Roth et al. |

(Continued)

FOREIGN PATENT DOCUMENTS

| | | | |
|---|---|---|---|
| DE | 102010051083 | | 8/2011 |
| WO | 2005034605 | A2 | 4/2005 |
| WO | 2006076730 | A2 | 7/2006 |

*Primary Examiner* — Loan H Thanh
*Assistant Examiner* — Megan Anderson
(74) *Attorney, Agent, or Firm* — Tarter Krinsky & Drogin LLP

(57) ABSTRACT

A strength training and stretching system may include a primary arcuated member extending from a lower portion of the strength training and stretching system to an upper portion of the strength training and stretching system, and a plurality of cleats disposed on the primary arcuated member at a plurality of different positions. Each cleat is configured to receive an exercise band.

22 Claims, 14 Drawing Sheets

(56) References Cited

U.S. PATENT DOCUMENTS 5,876,313 A 3/1999 Krull
5,885,196 A 3/1999 Gvoich
5,997,448 A 12/1999 Duba
6,015,371 A 1/2000 Davitt
6,033,350 A 3/2000 Krull
6,099,442 A 8/2000 Krull
6,142,919 A 11/2000 Jorgensen
6,186,927 B1 2/2001 Krull
6,202,263 B1 3/2001 Harker
6,238,324 B1 5/2001 MacMillan
6,322,481 B1 11/2001 Krull
6,322,483 B1 11/2001 Rotella
6,402,666 B2 6/2002 Krull
6,416,446 B1 7/2002 Krull
6,422,979 B1 7/2002 Krull
6,554,747 B1 4/2003 Rempe
6,561,956 B1 5/2003 Allison
6,626,801 B2 9/2003 Marques
6,629,910 B1 10/2003 Krull
6,669,606 B2 12/2003 Krull
6,679,816 B1 1/2004 Krull
6,733,424 B2 5/2004 Krull
6,746,381 B2 6/2004 Krull
6,749,547 B2 6/2004 Krull
6,872,173 B2 3/2005 Krull
6,899,661 B1 5/2005 Krull
6,902,515 B2 * 6/2005 Howell et al. ..... 482/62
6,902,516 B2 6/2005 Krull
6,908,418 B2 6/2005 Saure
6,974,405 B2 12/2005 Krull
7,032,529 B2 4/2006 Sanford
7,037,246 B2 5/2006 Kim
7,060,011 B1 6/2006 Krull
7,121,988 B2 10/2006 Walkerdine
7,128,697 B1 10/2006 Krull
7,153,243 B1 12/2006 Krull
7,192,391 B2 3/2007 Kim
7,223,213 B2 5/2007 Golesh
7,229,392 B2 6/2007 Turnbull et al.
7,264,578 B1 9/2007 Krull
7,429,236 B2 * 9/2008 Dalebout et al. ..... 482/123
7,455,632 B2 11/2008 Block et al.
7,497,814 B1 3/2009 Krull
7,510,539 B2 * 3/2009 Katane et al. ..... 602/36
7,547,268 B1 6/2009 Krull
7,553,265 B2 6/2009 Crawford et al.
7,572,212 B2 8/2009 Cassidy et al.
7,588,520 B2 9/2009 Nalley
7,611,450 B2 11/2009 Mancini
7,621,856 B1 11/2009 Keith et al.
7,625,325 B1 12/2009 Yost
7,632,221 B1 12/2009 Kolander
7,662,074 B2 2/2010 Webb
7,736,286 B2 6/2010 Panaiotov
7,740,568 B2 6/2010 Webb
7,766,804 B2 8/2010 Placencia
7,775,949 B2 8/2010 Bowser
7,785,242 B2 8/2010 Solomon
7,785,243 B2 8/2010 Kassel
7,794,373 B2 9/2010 Crawford et al.
7,798,945 B2 9/2010 Ko
7,798,946 B2 9/2010 Dalebout et al.
7,815,552 B2 10/2010 Dibble et al.
7,819,787 B2 10/2010 Kassel
D626,609 S * 11/2010 Grider ..... D21/694
7,857,739 B2 12/2010 Caldwell
7,878,954 B2 2/2011 McBride et al.
7,892,155 B2 2/2011 Pearson et al.
7,922,635 B2 4/2011 Lull et al.
D639,355 S 6/2011 Kassel
D639,356 S 6/2011 Kassel
8,002,677 B2 8/2011 Dibble et al.
D644,700 S 9/2011 Kassel
D645,919 S 9/2011 Kassel et al.
8,016,729 B2 9/2011 Webb
8,021,286 B2 9/2011 Suiter
8,033,960 B1 * 10/2011 Dalebout et al. ..... 482/38
8,057,371 B2 11/2011 McBride et al.
8,109,864 B2 * 2/2012 Tseng ..... 482/121
8,137,248 B1 3/2012 Krull
8,246,524 B2 * 8/2012 Castillo ..... 482/92
8,272,996 B2 9/2012 Weier
8,273,001 B2 9/2012 Karecki et al.
8,287,438 B2 10/2012 Krull
8,303,472 B2 11/2012 Bowser
8,317,660 B2 * 11/2012 Goranson ..... 482/23
8,499,383 B1 * 8/2013 Ungaro ..... 5/417
8,602,951 B2 12/2013 Morris
8,602,952 B1 12/2013 Cruz
8,657,727 B1 2/2014 Kassel et al.
8,690,741 B2 4/2014 Ross et al.
8,696,529 B2 4/2014 Krull
8,821,359 B1 * 9/2014 Kassel ..... 482/121
8,870,722 B2 10/2014 Kassel
8,905,905 B2 * 12/2014 Mangalindan ..... 482/141
2003/0017918 A1 1/2003 Webb et al.
2003/0232707 A1 12/2003 Dalebout et al.
2004/0009854 A1 1/2004 Shiang et al.
2005/0043150 A1 2/2005 Nitta et al.
2005/0049121 A1 * 3/2005 Dalebout et al. ..... 482/93
2005/0113219 A1 5/2005 Pierre, II
2005/0130814 A1 6/2005 Nitta et al.
2005/0272577 A1 12/2005 Olsen et al.
2006/0035768 A1 * 2/2006 Kowallis et al. ..... 482/123
2006/0128540 A1 6/2006 Engle
2007/0207903 A1 9/2007 Csabai
2009/0215594 A1 8/2009 Panaiotov
2010/0048368 A1 * 2/2010 Donofrio ..... 482/130
2010/0331152 A1 12/2010 Pedrera
2011/0124476 A1 5/2011 Holley
2011/0237410 A1 9/2011 Perez
2011/0269604 A1 * 11/2011 Tseng ..... 482/121
2012/0214651 A1 8/2012 Ross
2013/0225371 A1 * 8/2013 Harrer et al. ..... 482/8
2013/0225372 A1 8/2013 Rochford
2014/0066274 A1 3/2014 Kassel

* cited by examiner

STRENGTH TRAINING AND STRETCHING SYSTEM

BACKGROUND

1. Technical Field

Exemplary embodiments of the present invention relate to a strength training and stretching system, and more particularly, to a customizable and ergonomically designed strength training and stretching system that allows a user to conveniently and effectively perform and track with precision a variety of different exercises that simultaneously engage multiple muscle groups.

2. Discussion of Related Art

A variety of exercises can be performed using exercise bands. For example, resistance bands, straps, and ropes may be used to perform a variety of strength training and stretching exercises. Depending on the type of exercise being performed, a user may want to secure one or more exercise bands to a stationary device. For example, a user may secure an exercise band to a door using a door anchor, or wrap an exercise band around a sturdy object such as a pole or piece of furniture. Different exercises may require a user to secure one or more exercise bands to a stationary device at different angles in order to optimize the effectiveness of the particular exercise being performed. Further, exercise bands may be utilized with certain fitness equipment such as, for example, a pull-up bar or a dip bar, to improve the effectiveness of exercises typically performed using the fitness equipment.

BRIEF SUMMARY

According to an exemplary embodiment of the present disclosure, a fitness system includes a primary arcuated member extending from a lower portion of the fitness system to an upper portion of the fitness system, and a first plurality of cleats disposed on the primary arcuated member at a plurality of different positions on the primary arcuated member. Each cleat of the first plurality of cleats is configured to receive an exercise band.

According to an exemplary embodiment of the present disclosure, a fitness system includes a primary arcuated member extending from a lower portion of the fitness system to an upper portion of the fitness system, and a first plurality of cleats disposed on the primary arcuated member at a plurality of different positions on the primary arcuated member. Each cleat of the first plurality of cleats is configured to receive an exercise band. The primary arcuated member curves outward in a first direction between the lower portion and a middle portion of the fitness system, curves inward in a second direction between the middle portion and the upper portion, and curves downward at the upper portion.

According to an exemplary embodiment of the present disclosure, a fitness system includes a primary arcuated member extending from a lower portion of the fitness system to an upper portion of the fitness system, a first plurality of cleats disposed on the primary arcuated member at a plurality of different positions on the primary arcuated member, a first ancillary arcuated member extending from the primary arcuated member, a second plurality of cleats disposed on the first ancillary arcuated member at a plurality of different positions on the first ancillary arcuated member, a second ancillary arcuated member extending from the primary arcuated member, a third plurality of cleats disposed on the second ancillary arcuated member at a plurality of different positions on the second ancillary arcuated member, a first pair of band legs disposed near the lower portion of the fitness system, a fourth plurality of cleats disposed on the first pair of band legs at a plurality of different positions on the first pair of band legs, a second pair of band legs disposed near the lower portion of the fitness system, and a fifth plurality of cleats disposed on the second pair of band legs at a plurality of different positions on the second pair of band legs. Each cleat of the first, second, third, fourth, and fifth plurality of cleats is configured to receive an exercise band.

BRIEF DESCRIPTION OF THE SEVERAL VIEWS OF THE DRAWINGS

The above and other features of the present disclosure will become more apparent by describing in detail exemplary embodiments thereof with reference to the accompanying drawings, in which.

DETAILED DESCRIPTION

Exemplary embodiments of the present disclosure now will be described more fully hereinafter with reference to the accompanying drawings. This disclosure, may however, be embodied in many different forms and should not be construed as limited to the exemplary embodiments set forth herein.

Exemplary embodiments of the present disclosure provide a strength training and stretching system designed to allow a user to conveniently and effectively perform a variety of different exercises. According to exemplary embodiments, a customizable and ergonomically designed strength training and stretching system allows a user to conveniently and effectively perform and track with precision a variety of different exercises that simultaneously engage multiple muscle groups.

Figure 4:
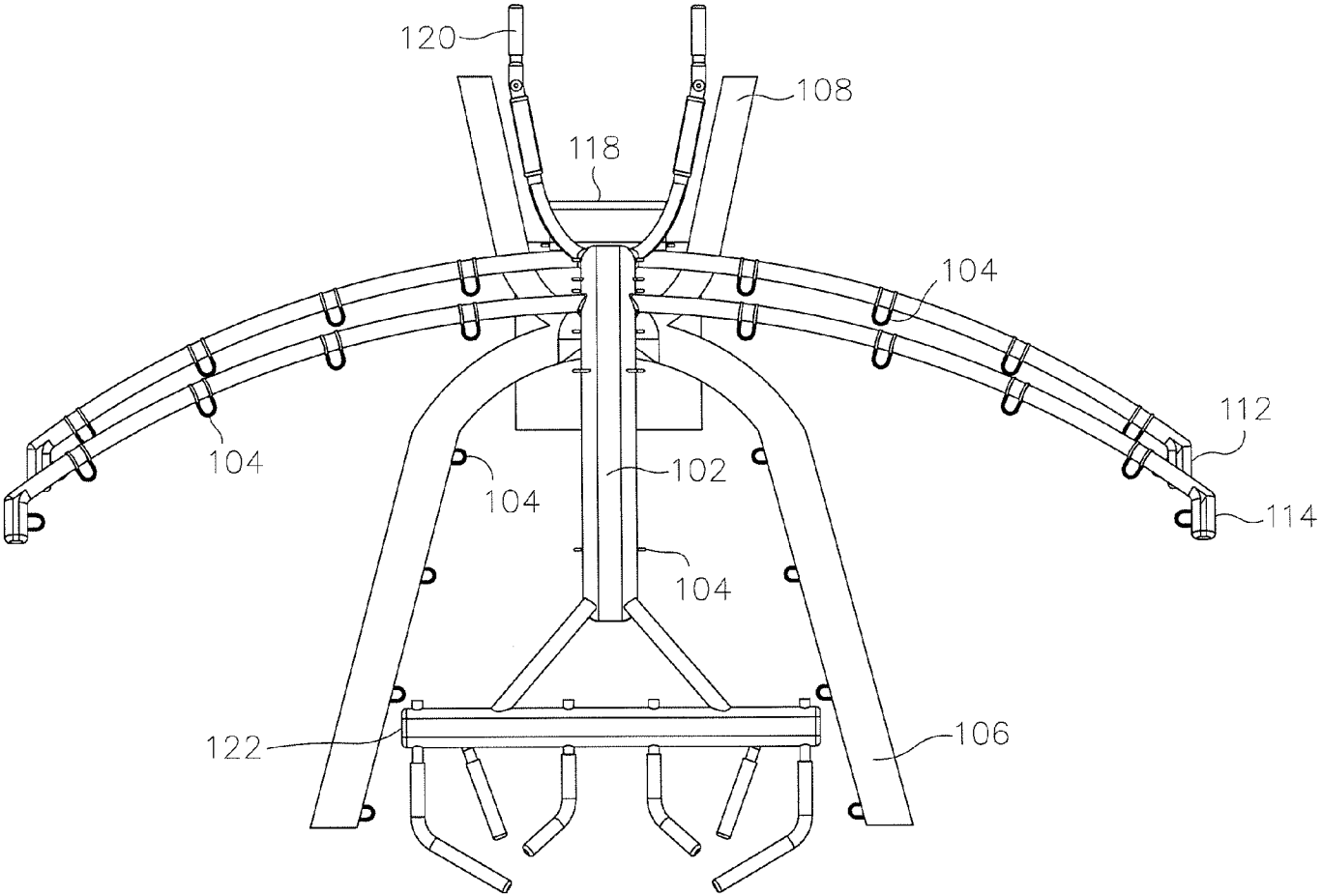
FIG. 4 is a top view of a strength training and stretching system, according to an exemplary embodiment of the present disclosure.
Figure 5:
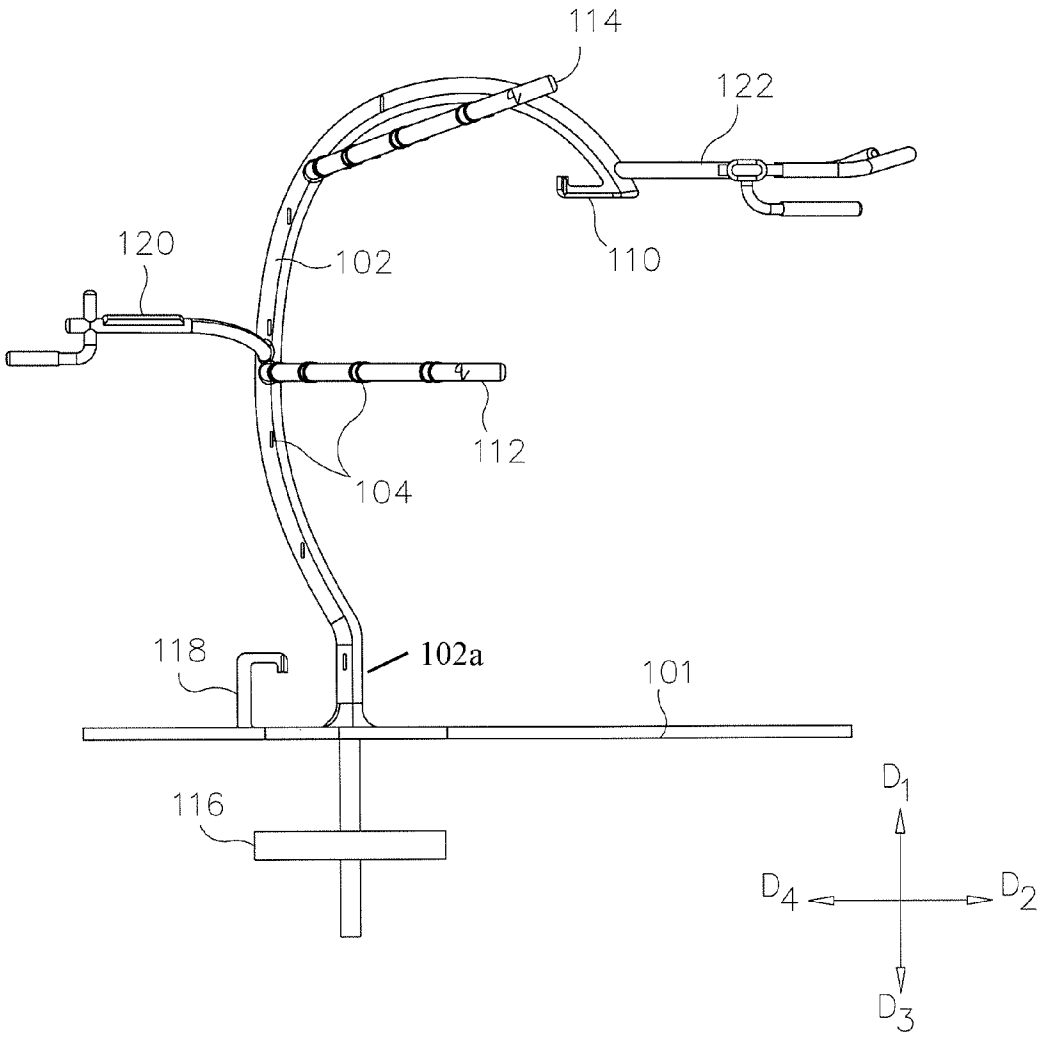
FIG. 5 is a side view of a strength training and stretching system, according to an exemplary embodiment of the present disclosure.

FIGS. 1 to 6 show a strength training and stretching system according to exemplary embodiments of the present disclosure. More specifically, FIGS. 1 to 3 and 6 show perspective views of the strength training and stretching system according to exemplary embodiments, FIG. 4 shows a top view of the strength training and stretching system according to an exemplary embodiment, and FIG. 5 shows a side view of the strength training and stretching system according to an exemplary embodiment. FIGS. 9 to 14 show a user performing a small sample of various exercises using a strength training and stretching system according to exemplary embodiments.

The strength training and stretching system 100 may be constructed from a variety of materials. For example, various components of the strength training and stretching system 100 may include, but are not limited to, steel, aluminum, plastic, rubber, cement, brass, VELCRO, a variety of woven fabrics, a variety of padding materials, etc.

The strength training and stretching system 100 includes a primary arcuated member 102 extending from a lower portion of the strength training and stretching system 100 toward an upper portion of the strength training and stretching system 100. The lower portion may refer to the portion of the strength training and stretching system 100 at or near a ground surface, and the upper portion may refer to the portion of the strength training and stretching system 100 at or near the opposing end (e.g., the uppermost end) of the strength training and stretching system 100. A middle portion may refer to the portion of the strength training and stretching system 100 at or near an area between the lower and upper portions. The primary arcuated member 102 may be custom manufactured based on the size of the user. The primary arcuated member 102 is ergonomically curved to provide the most effective angles for a variety of exercises that simultaneously engage multiple muscle groups (e.g., the primary arcuated member 102 is bow-shaped/C-shaped), as shown in FIGS. 1 to 6.

As used herein, a D1 direction may be referred to as an upward direction, a D2 direction may be referred to as a front direction, a D3 direction may be referred to as a downward direction, and a D4 direction may be referred to as a back or rear direction.

For example, referring to the side view shown in FIG. 5, in an exemplary embodiment, the primary arcuated member 102 may curve outward in the direction D4 between the lower portion and the middle portion, may curve inward in the direction D2 between the middle portion and the upper portion, and may curve downward in the direction D3 near the upper portion. The primary arcuated member 102 may include a non-curved portion 102*a* extending substantially upward from the ground surface 101 near the lower portion, and a suspension member 110 extending inward from the primary arcuated member 102, as shown in FIG. 5. As used herein, the ground surface 101 may refer to any type of outdoor or indoor surface that the strength training and stretching system 100 is disposed on.

The primary arcuated member 102 includes a plurality of cleats 104 disposed thereon at predefined intervals. The curved shape of the primary arcuated member 102 allows the cleats 104 to be disposed at a plurality of different locations, and in a plurality of different angles relative to the primary arcuated member 102. Each of the cleats 104 is configured to receive an exercise band. The plurality of cleats 104 are further described below. The cleats 104 may be composed of a variety of materials including, for example, steel or another metal. The cleats may be a separate component attached to the primary arcuated member 102 attached via, for example, welding, or may be manufactured as part of the primary arcuated member 102. The cleats 104 provide an attachment point for an exercise band to be securely attached to the strength training and stretching system 100. For example, each cleat 104 may provide a receiving portion (e.g., a closed loop) into which a securing mechanism (e.g., a clip, such as a carabiner clip) of the exercise band may be securely attached to. According to exemplary embodiments, the cleats 104 may wrap around or be disposed on a portion of the primary arcuated member 102. Herein, cleats 104 included on various components of the strength training and stretching system 100, including first and second ancillary arcuated members, front and rear band legs, a plank member, and a suspension member, as described in more detail below, may be the same as or similar to the cleats 104 described with reference to the primary arcuated member 102.

Figure 8:
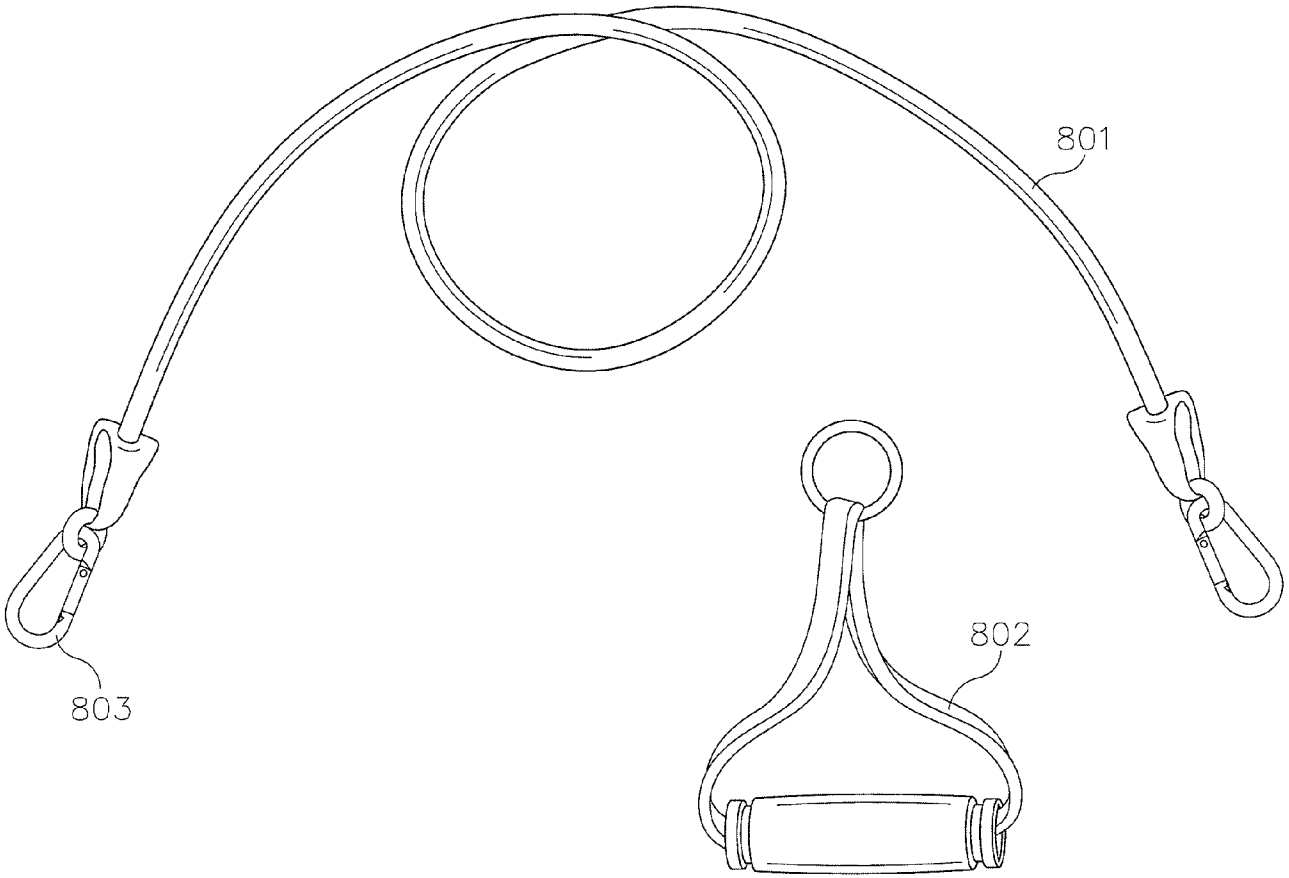
FIG. 8 illustrates an exercise band and exercise handle that may be used with a strength training and stretching system, according to an exemplary embodiment of the present disclosure.

As used herein, the term exercise band refers to any type of elongated member that may be used to perform physical exercises and activities. An exemplary embodiment of an exercise band 801 is shown in FIG. 8. For example, an exercise band may include a stretchable resistance band (also sometimes referred to as an exercise cord or fitness band) formed of a plastic tubing, or a non-stretchable exercise band (e.g., a strap or rope) used to perform various muscle strengthening, stretching (e.g., dynamic stretching, static stretching), and/or suspension exercises. It is to be understood that the strength training and stretching system 100 may be used with any type of exercise band including typical exercise bands commercially available to a consumer, such as TRX straps, as well as auto-centering resistance bands according to exemplary embodiments of the present disclosure, as described below. A handle 802 of the exercise band may be formed as part of the exercise band 801, or may be a separate component that attaches to the exercise band 801 as shown in FIG. 8 using clips such as, for example, carabiner clips 803, however use of the strength training and stretching system 100 is not limited to the exercise band 801 and/or handle 802 shown in FIG. 8.

Exercise bands may be attached to the cleats 104 in a variety of manners, including, for example, via a clip (e.g., a carabiner clip 803), or by inserting a portion of the exercise band through an opening of the cleat 104. FIGS. 9 to 14 show exercise bands attaching to the cleats 104 of the strength training and stretching system 100 for use during certain exercises, however, exemplary embodiments are not limited thereto. The strength training and stretching system 100 may be utilized with exercise bands having any length, thickness, and/or diameter. For example, the strength training and stretching system 100 may be utilized with exercise bands or straps having a length of about 1 foot to about 6 feet, and a diameter or width of about 0.25 inches to about 2 inches, however the strength training and stretching system 100 is not limited thereto. As a result, the user may perform various exercises involving different tension levels.

As a result of the curved shape of the primary arcuated member 102, and because cleats 104 are disposed at a plurality of different positions on the primary arcuated member 102, exercise bands may be attached to the primary arcuated member 102 at various different angles with respect to the primary arcuated member 102. That is, the user is not limited to one or few angles when performing exercises that utilize one or more exercise bands that attach to the primary arcuated member 102, and the user can employ the most ergonomically effective placement of one or more exercise bands for a particular exercise. As a result, this configuration allows a user to connect exercise bands to the strength training and stretching system 100 at the highest impact angle for the particular exercise being performed by the user. A small sample of the various exercises that may be performed using the strength training and stretching system 100 are described below with reference to FIGS. 9 to 14.

The cleats 104 may be disposed on the primary arcuated member 102 on any of the sides or surfaces of the primary arcuated member 102. For example, according to exemplary embodiments, the cleats 104 may be disposed on one or more side surfaces of the primary arcuated member 102, as shown in FIGS. 1 to 6, on an inner surface (e.g., the surface facing direction D2 as shown in FIG. 5) of the primary arcuated member 102, or on the outer surface (e.g., the surface facing direction D4 as shown in FIG. 5) of the primary arcuated member 102. Further, in an exemplary embodiment, the cleats 104 may be disposed on a combination of one or more of the outer surface, inner surface, and/or side surface(s) of the primary arcuated member 102.

As described above, the cleats 104 disposed on the primary arcuated member 102 may be disposed at predefined intervals. For example, the cleats 104 may be disposed at intervals of about 1 foot (e.g., about 1 foot of space may exist between each of the cleats 104), however the interval is not limited thereto. The cleats 104 may be approximately evenly spaced along the entire primary arcuated member 102, or the space between cleats 104 may be varied along the primary arcuated member 102 in certain areas. For example, in an exemplary embodiment, the cleats 104 may be approximately evenly spaced along most of the primary arcuated member 102, and may be spread apart from each other further at certain other areas of the primary arcuated member 102 (e.g., near the peak of the primary arcuated member 102).

The strength training and stretching system 100 may include first and/or second ancillary arcuated members 112 and 114. The first and second ancillary arcuated members 112 and 114 may be custom manufactured based on the size of the user. The first and second ancillary arcuated members 112 and 114 are substantially in direction D2, as shown in FIG. 5. The first ancillary arcuated member 112 may be disposed substantially near the middle portion of the strength training and stretching system 100, as shown in FIGS. 1 to 3 and 5 to 6. The first ancillary arcuated member 112 extends in a direction substantially transverse from the primary arcuated member 102. In an exemplary embodiment, the first ancillary arcuated member 112 extends in a substantially perpendicular direction relative to the primary arcuated member 102 and extends in a direction substantially parallel to the ground surface 101, as shown in FIG. 5, however the first ancillary arcuated member 112 is not limited thereto. For example, the first ancillary arcuated member 112 may be angled in an upward or downward direction relative to the primary arcuated member 102.

Similarly, the second ancillary arcuated member 114 may be substantially parallel to the ground surface 101, or angled in an upward or downward direction with respect to the primary arcuated member 102 and the ground surface 101. In an exemplary embodiment, the respective angles of the first and second ancillary arcuated members 112 and 114 may be substantially the same or different. For example, in FIG. 5, the first ancillary arcuated member 112 is substantially parallel to the ground surface 101, and the second ancillary arcuated member 114 is angled in an upward direction with respect to the primary arcuated member 102. The angle at which the first and/or second ancillary arcuated members 112 and 114 are disposed with respect to the primary arcuated member 102 may be about −20 degrees to about 45 degrees, however the angle of each arcuated member is not limited thereto. For example, the angle of each arcuated member may be customized for the user.

Similar to the primary arcuated member 102, the first and second ancillary arcuated members 112 and 114 are ergonomically curved to provide the most effective angles for a variety of exercises (e.g., the first and second ancillary arcuated members 112 and 114 are bow-shaped/C-shaped), as shown in FIGS. 1 to 6. As a result, the user is not limited to one or few angles when performing exercises that utilize one or more exercise bands that attach to the first and/or second ancillary arcuated members 112 and 114, and the user can employ the most ergonomically effective placement for a particular exercise.

Each of the first and second ancillary arcuated members 112 and 114 includes a plurality of cleats 104. Each of the cleats 104 is configured to receive an exercise band, and may be disposed at predefined intervals, as described above with reference to the cleats 104 disposed on the primary arcuated member 102. For example, the cleats 104 may be disposed at intervals of about 1 foot (e.g., about 1 foot of space may exist between each of the cleats 104), however the interval is not limited thereto. The cleats 104 may be approximately evenly spaced along the entire first and/or second ancillary arcuated members 112 and 114, or the space between cleats 104 may be varied along the first and/or second ancillary arcuated members 112 and 114 in certain areas.

According to exemplary embodiments, the cleats 104 disposed on the first and second ancillary arcuated members 112 and 114 may be disposed on the inner surface (e.g., the surface facing direction D2 as shown in FIG. 5), the outer surface (e.g., the surface facing direction D4 as shown in FIG. 5), a side surface(s), or a combination of surfaces of the first and second ancillary arcuated members 112 and 114. In an exemplary embodiment, the cleats 104 disposed on the primary arcuated member 102 are disposed on the side surfaces of the primary arcuated member 102, and the cleats 104 disposed on the first and second ancillary arcuated members 112 and 114 are disposed on the respective inner surfaces of the first and second ancillary arcuated members 112 and 114 (e.g., the surfaces facing direction D2 as shown in FIG. 5), as shown in FIGS. 1 to 6.

Exemplary embodiments of the present disclosure may include the primary arcuated member 102 and both the first and second ancillary arcuated members 112 and 114 as shown in FIGS. 1 to 6, the primary arcuated member 102 and one of the ancillary arcuated members 112 and 114, or only the primary arcuated member 102.

The lower portion of the strength training and stretching system 100 includes front band legs 106 extending in the D2 direction, and rear band legs 108 extending in the D4 direction, as shown in FIG. 5. In an exemplary embodiment, the front and rear band legs 106 and 108 may provide structural support for the strength training and stretching system 100. For example, the strength training and stretching system may be secured to the ground surface 101 by securing the front and rear band legs 106 and 108 to the ground surface 101 using coupling members (e.g., bolts, screws, etc.) extending through the front and/or rear band legs 106 and 108 and into the ground surface 101. Such a configuration may be implemented in an embodiment in which the strength training and stretching system 100 is configured to be installed in an indoor setting, as well as an outdoor setting. The length of the front band legs 106 in the D2 direction may be about 5 feet to about 7 feet, and the length of the rear band legs 108 in the D4 direction may be about 3 feet to about 5 feet. The front band legs 106 may be spaced apart such that additional exercise equipment may be utilized in conjunction with the strength training and stretching system 100 when performing certain exercises. For example, the distance between the front band legs 106 may be about 4 feet to about 6 feet, allowing the user to place a BOSU ball, balance disc(s), balance board, exercise ball, exercise bench, etc., in the area between the front band legs 106 while using the strength training and stretching system 100. The distance between the rear band legs 108 may be about 3 feet to about 4.5 feet.

In an exemplary embodiment, the front band legs 106 and/or the rear band legs 108 may include a plurality of cleats 104, as shown in FIGS. 1 to 4 and 6. The cleats 104 on the front and rear band legs 106 and 108 are configured to receive an exercise band, and are disposed at predefined intervals, as described above with reference to the cleats on the arcuated members. For example, the cleats 104 may be disposed at intervals of about 1 foot (e.g., about 1 foot of space may exist between each of the cleats 104), however the interval is not limited thereto. The cleats 104 may be approximately evenly spaced along the entire front and/or rear band legs 106 and 108, or the space between cleats 104 may be varied along the front and/or rear band legs 106 and 108 in certain areas.

According to exemplary embodiments, the cleats 104 may be disposed on the inner surface of the front and rear band legs 106 and 108, as shown in FIGS. 1 to 4 and 6, however, exemplary embodiments are not limited thereto. For example, in exemplary embodiments, the cleats 104 may be disposed on the upper surface of the front and rear band legs 106 and 108, on the outer surface of the front and rear band legs 106 and 108, or on any combination of surfaces.

The suspension member 110 may be utilized to perform various exercises including, for example, suspension exercises involving a non-stretchable exercise band (e.g., a rope or strap such as a TRX strap). The non-stretchable exercise band may be secured to the suspension member 110 utilizing a lip of the suspension member 110 and/or a cleat 104 disposed on the suspension member 110.

As a result of the curved shape of the ancillary arcuated member 112 and 114, as well as the front and rear band legs 106 and 108, and because cleats 104 are disposed at a plurality of different positions thereon, exercise bands may be attached to the various different components of the strength training and stretching system 100 at various different angles. That is, the user is not limited to one or few angles when performing exercises that utilize one or more exercise bands that attach to the strength training and stretching system 100, and the user can employ the most ergonomically effective placement of one or more exercise bands for a particular exercise. As a result, this configuration allows a user to connect exercise bands to the strength training and stretching system 100 at the highest impact angle for the particular exercise being performed by the user.

FIGS. 9 to 14 depict a user performing a variety of exercises using the strength training and stretching system 100. It is to be understood that the exercises shown in FIGS. 9 to 14 are only some examples of many exercises that may be performed using the strength training and stretching system 100. As shown in the figures, disposition of the cleats 104 at various positions and angles on the arcuated members 102, 112 and 114, the band legs 106 and 108, the suspension member 110, and/or the plank member 118 allows a user to conveniently perform a variety of exercises by connecting one or more exercise bands to the strength training and stretching system 100 at various angles, including the highest impact angle for the particular exercise being performed. As a result of this configuration, a variety of asymmetric exercises may also be performed via the non-parallel placement of exercise bands. Although FIGS. 9 to 14 do not show a user utilizing additional exercise equipment in conjunction with the strength training and stretching system 100 and exercise bands, such additional exercise equipment may be utilized. For example, a BOSU ball, balance disc(s), balance board, exercise ball, etc., may also be utilized in the illustrated exercises (e.g., the user may stand, sit, or lean on this equipment during certain exercises to adjust the difficulty of the exercises and/or to place more focus on certain muscle groups).

Figure 9:
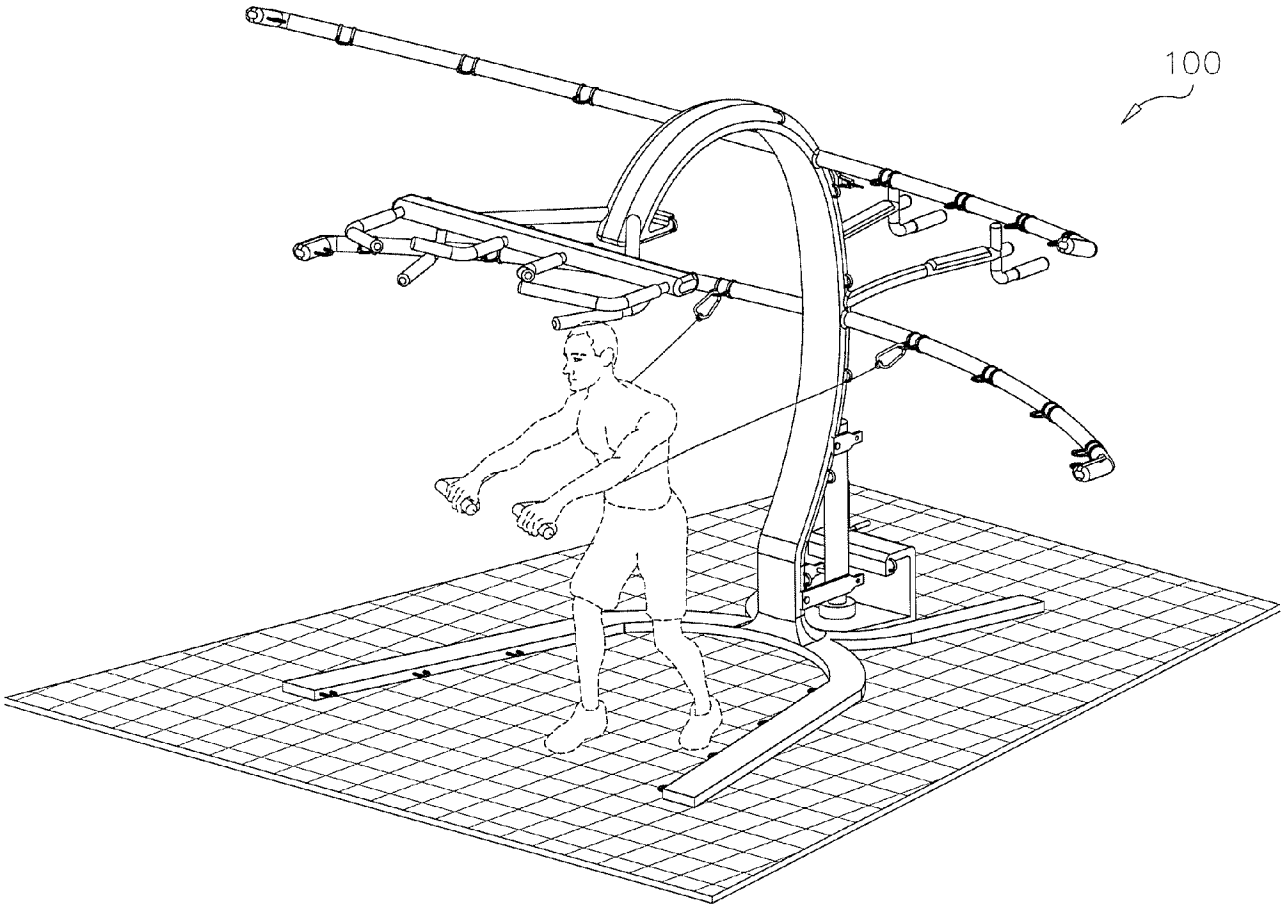
FIGS. 9 to 14 illustrate a user performing a small sample of various exercises using a strength training and stretching system, according to exemplary embodiments of the present disclosure.
Figure 10:
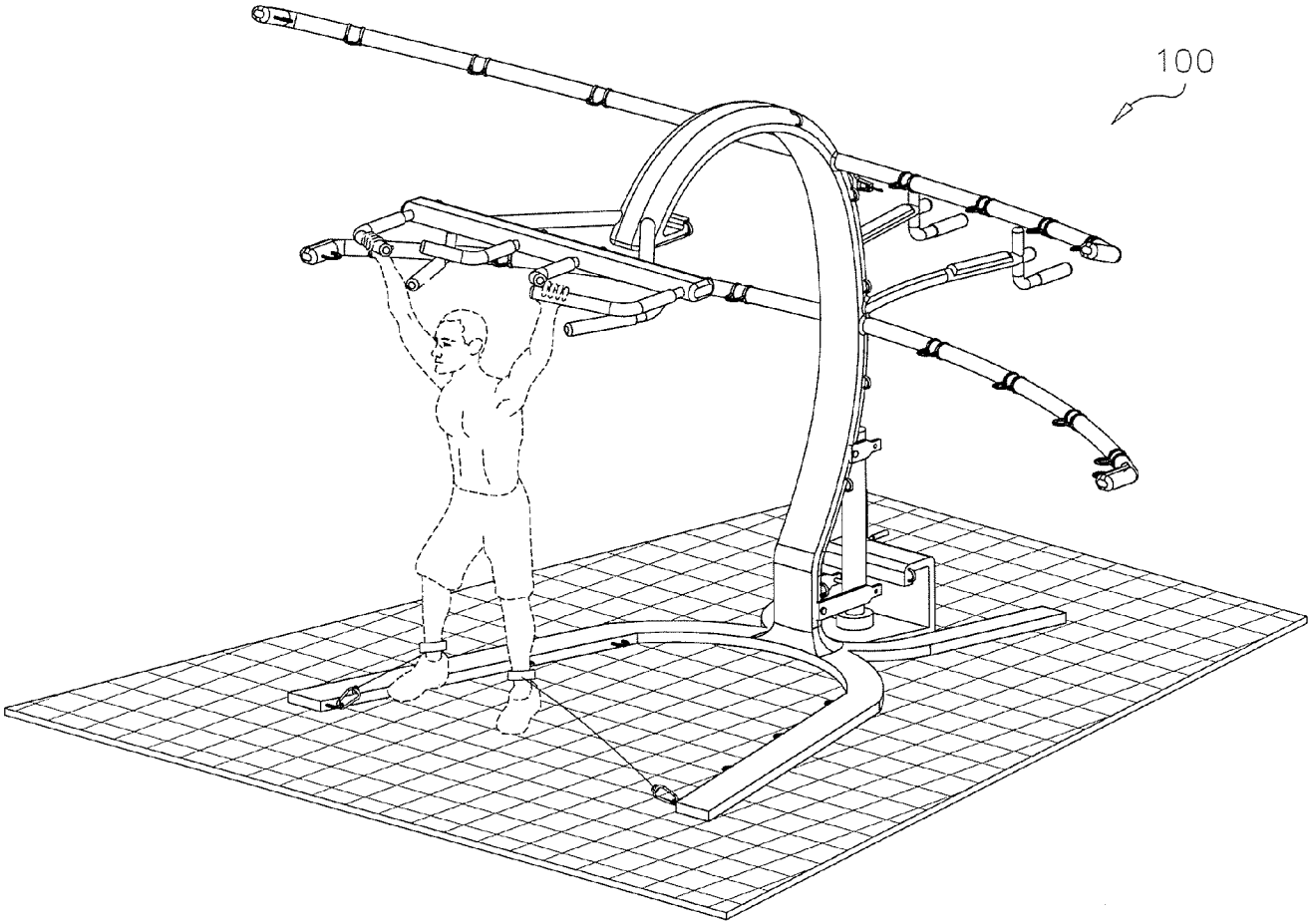
Figure 11:
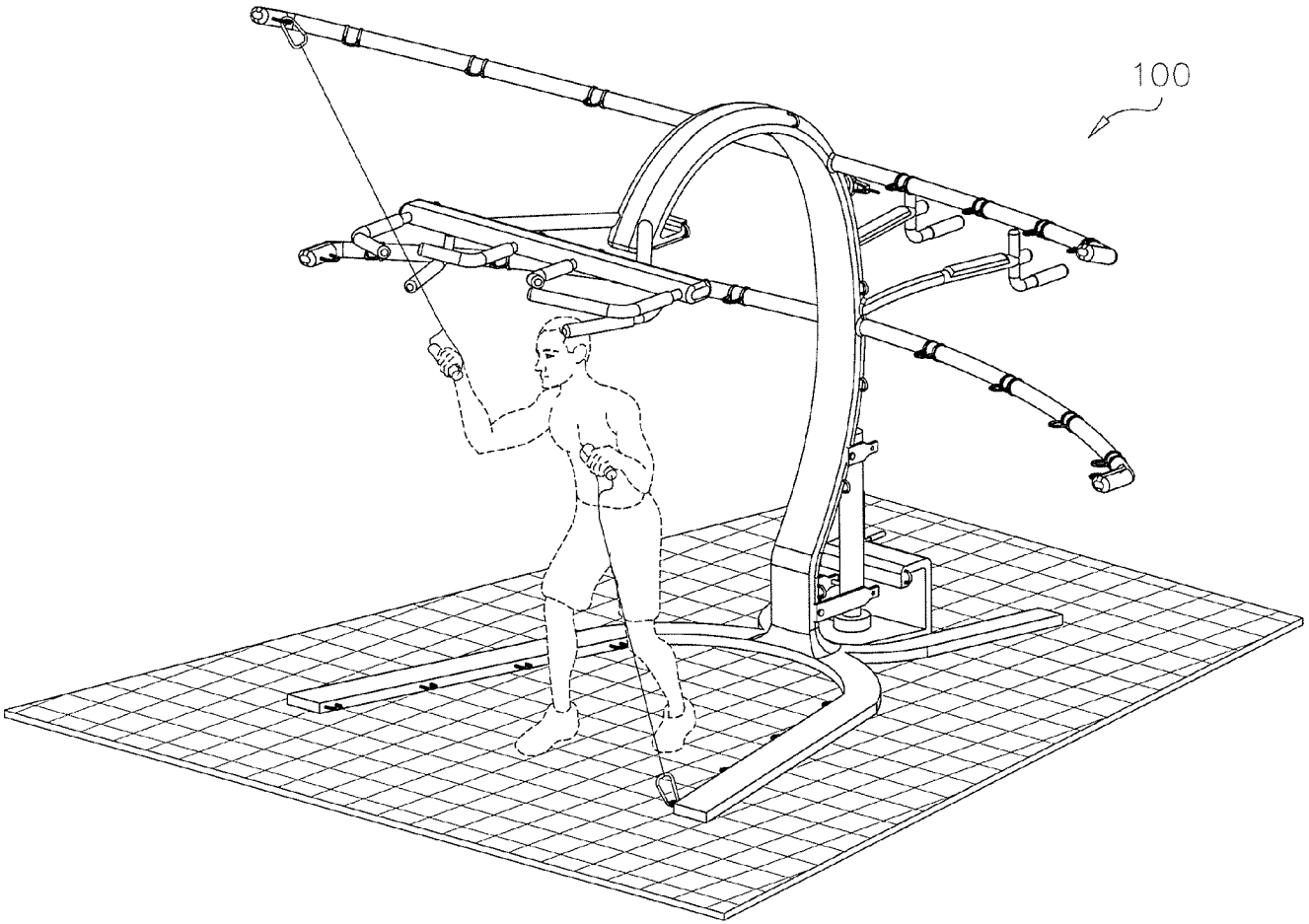
Figure 12:
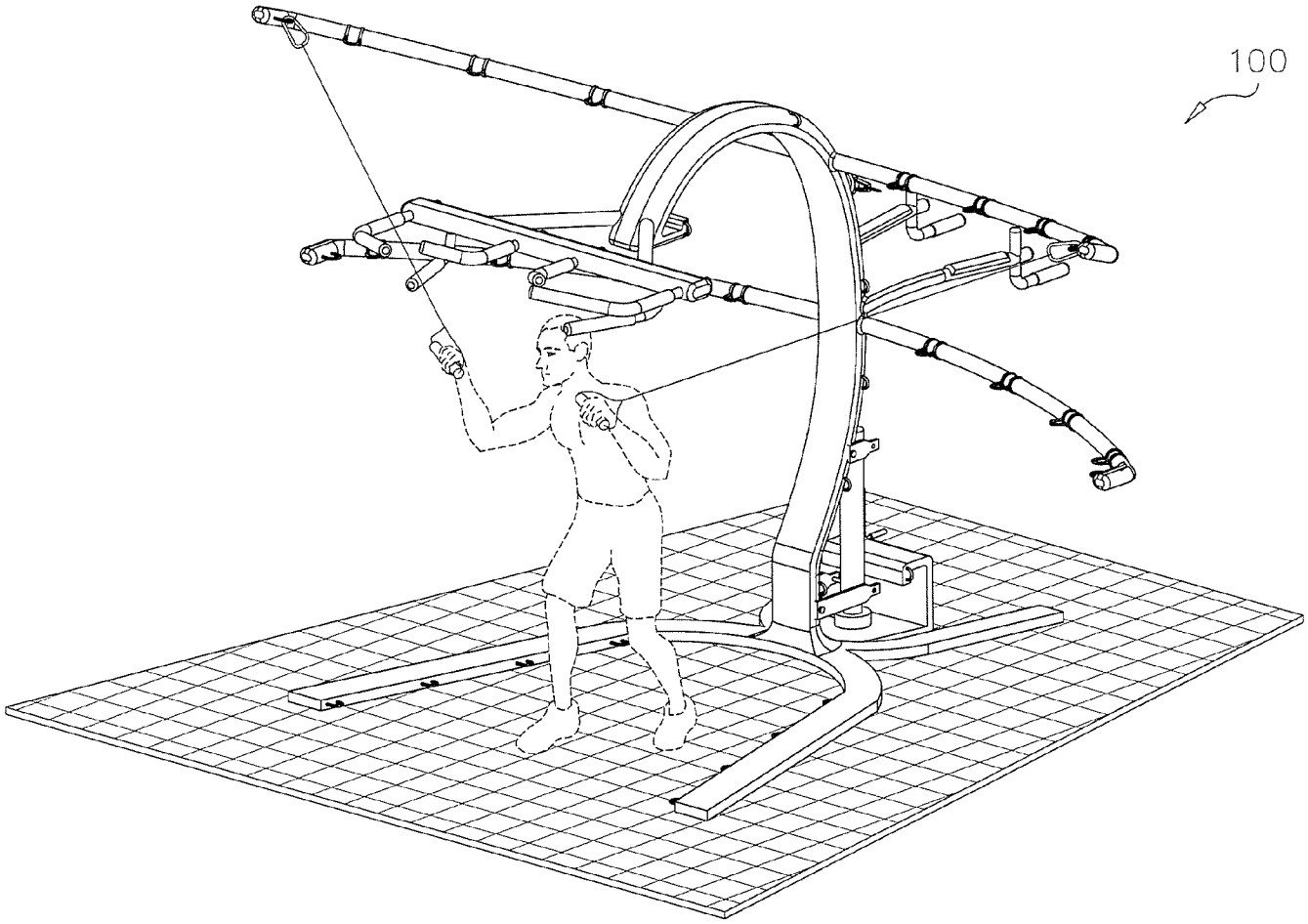
Figure 13:
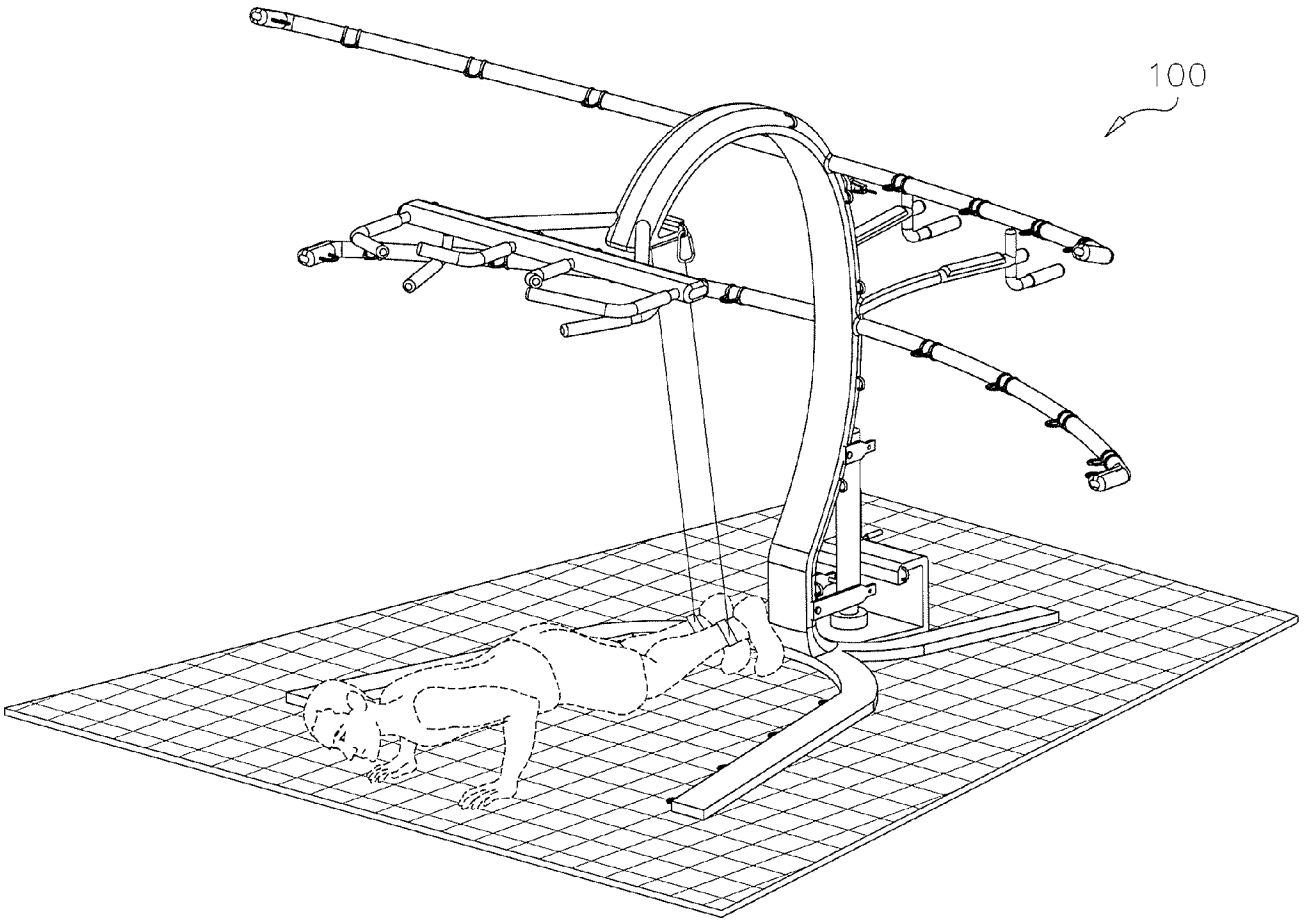
Figure 14:
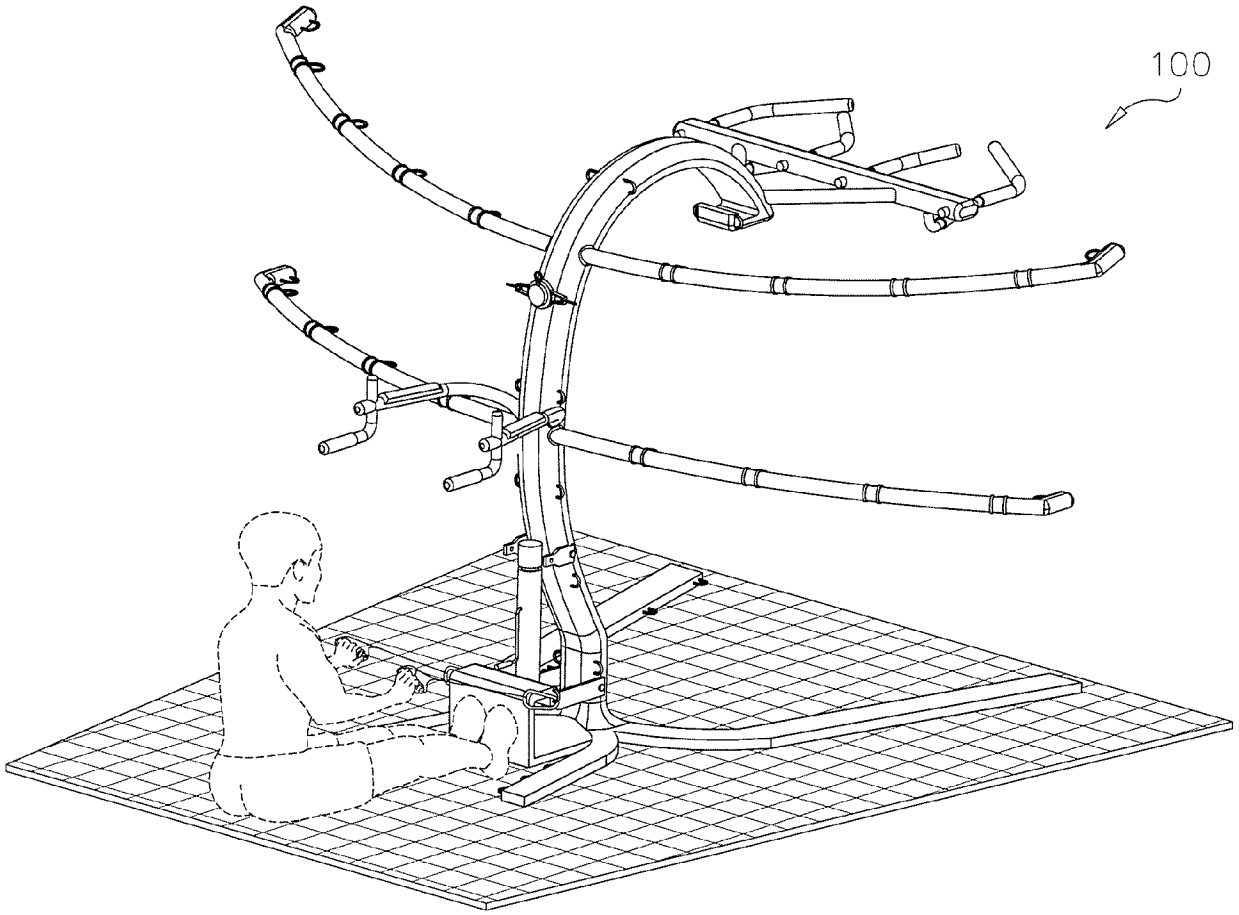

For example, FIG. 9 shows a user performing a standing resistance chest press utilizing exercise bands attached to cleats 104 of the first ancillary arcuated member 112. FIG. 10 shows a user performing pull-ups utilizing the pull-up bar member 122 and exercise bands attached to the user's ankle via ankle straps and cleats 104 of the front band legs 106. In a similar fashion, the user may perform dips utilizing the dip bar member 120 and exercise bands attached to the user's knee via knee straps and cleats 104 of the rear band legs 108. Different handles disposed on the pull-up bar member 122 and the dip bar member 120 may be utilized during these exercises. FIG. 11 shows a user performing an asymmetric exercise utilizing a cleat 104 of the second ancillary arcuated member 114 and a cleat 104 of the front band legs 106. FIG. 12 shows a user performing a lat pull-down exercise utilizing two exercise bands attached to cleats 104 of the second ancillary arcuated member 114. FIG. 13 shows a user performing push-up and plank exercises utilizing exercise bands (e.g., straps such as TRX straps) attached to cleats 104 of the suspension member 110. Similar exercises may also be performed utilizing the lip of the suspension member 110 rather than cleats 104 of the suspension member 110. FIG. 14. shows a user performing a row plank exercise utilizing exercise bands attached to cleats 104 of the plank member 118. Similar exercises may also be performed utilizing the lip of the plank member 118 rather than cleats 104 of the plank member 118. In addition to the exercises illustrated in FIGS. 9 to 14, various exercises that utilize cleats 104 disposed on the primary arcuated member 102, either alone or in combination with cleats 104 disposed on other components of the strength training and stretching system 100, only the pull-up bar member 122, only the dip bar member 120, or only the plank member 118 may be performed.

In an exemplary embodiment, the strength training and stretching system 100 may include an in-ground anchor member 116 configured to secure the strength training and stretching system 100 within the ground floor 101. For example, the in-ground anchor member 116 may be utilized when securing the strength training and stretching system 100 within a ground floor 101 in an outdoor environment. The in-ground anchor member 116 may be placed into a mounting area of the ground surface 101 to secure the strength training and stretching system 100 to the ground surface 101. The mounting area may be, for example, an area extending into the ground surface 101 including concrete, into which the in-ground anchor member 116 is inserted. The in-ground anchor member 116 may be about 3 feet to about 5 feet deep. When the strength training and stretching system 100 is utilized in an indoor environment, for example, by securing the front and rear band legs 106 and 108 to the ground surface 101 as described above, the strength training and stretching system 100 may not include the in-ground anchor member 116.

The strength training and stretching system 100 may include a plank member 118, as shown in FIGS. 1 to 6. The plank member 118 may be a C-shaped member, as shown in FIGS. 1 to 3 and 5 to 6. The C-shaped plank member 118 may include a lip portion extending downward and inward near the upper end of the plank member 118. The lip portion allows the user to connect an exercise band to the plank member 118 to perform various exercises. The plank member 118 may further include one or more cleats 104 disposed on one or more surfaces of the plank member 118 and configured to receive an exercise band, as described above.

The strength training and stretching system 100 may further include one or more of a dip bar member 120 and a pull-up bar member 122, as shown in FIGS. 1 to 6. The dip bar member 120 may extend from the middle portion of the primary arcuated member 102 in the D4 direction, and the pull-up bar member 122 may extend from the upper portion of the primary arcuated member 102 in the D2 direction, as shown in FIG. 5. Each of the dip bar member 120 and the pull-up bar member 122 may include a plurality of handles disposed in different orientations, and extending in different directions, as shown in FIGS. 1 to 6. The different orientations and directions of the various handles allow the user to perform a variety of exercises, either without utilizing exercise bands, or in conjunction with exercise bands attached to various cleats 104 of the strength training and stretching system 100, as shown in FIGS. 9 to 14. Each of the dip bar member 120 and the pull-up bar member 122 may be between about 3 feet and about 4 feet long, however, the length is not limited thereto. In an exemplary embodiment, the dip bar member 120 and the pull-up bar member 122 are about 3.5 feet long.

The strength training and stretching system 100 may be custom built based on the size of the user. For example, typical dimensions for the strength training and stretching system 100 may include a primary arcuated member 102 having a length of about 10 feet to about 12 feet. As a result of the curved shape of the primary arcuated member 102, a height of the primary arcuated member 102 may be between about 7 feet and about 8 feet. The first and/or second ancillary arcuated members 112 and 114 may have a larger span compared to the primary arcuated member 102. For example, the length of each of the first and second ancillary arcuated members 112 and 114 may be between about 10 feet and about 14 feet (e.g., the length of each portion of the first and second ancillary arcuated members 112 and 114 extending from the primary arcuated member 102 may be between about 5 feet and about 7 feet). However, the height and respective lengths of the arcuated members are not limited thereto.

Figure 1:
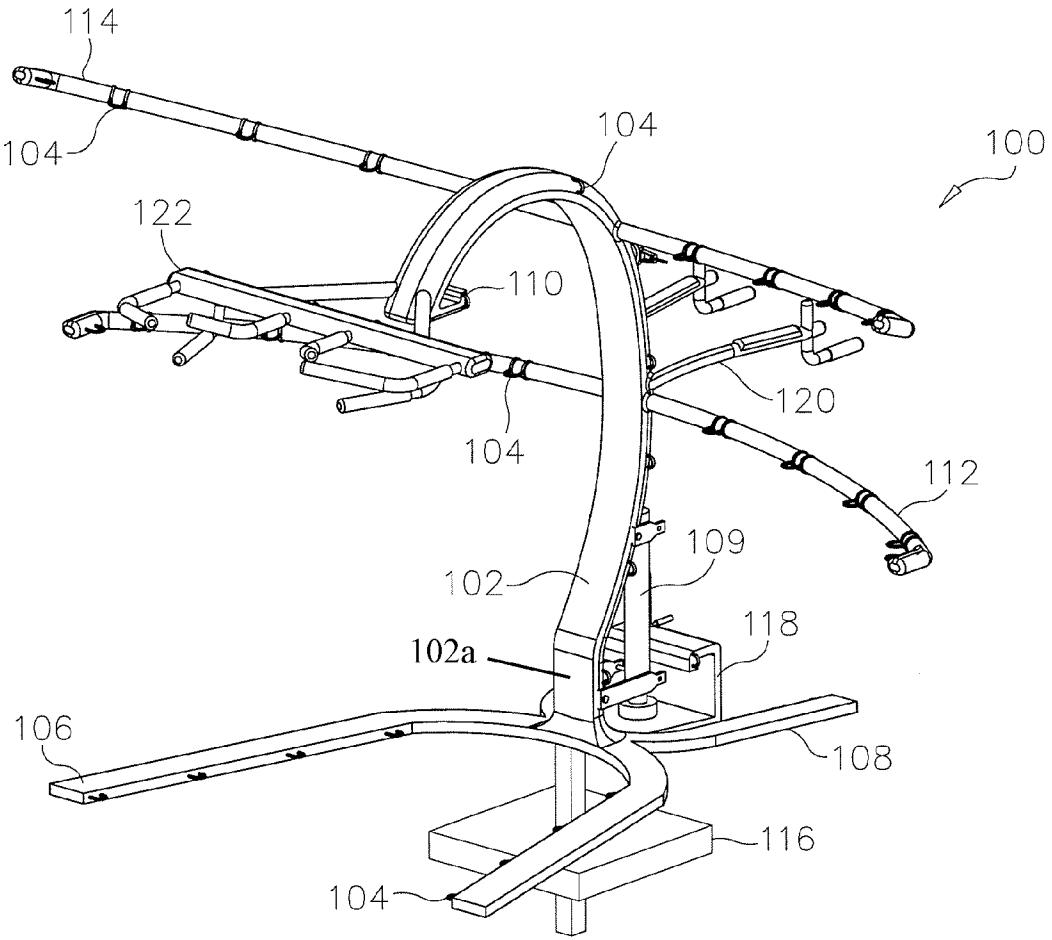
FIGS. 1 to 3 are perspective views of a strength training and stretching system, according to exemplary embodiments of the present disclosure.
Figure 2:
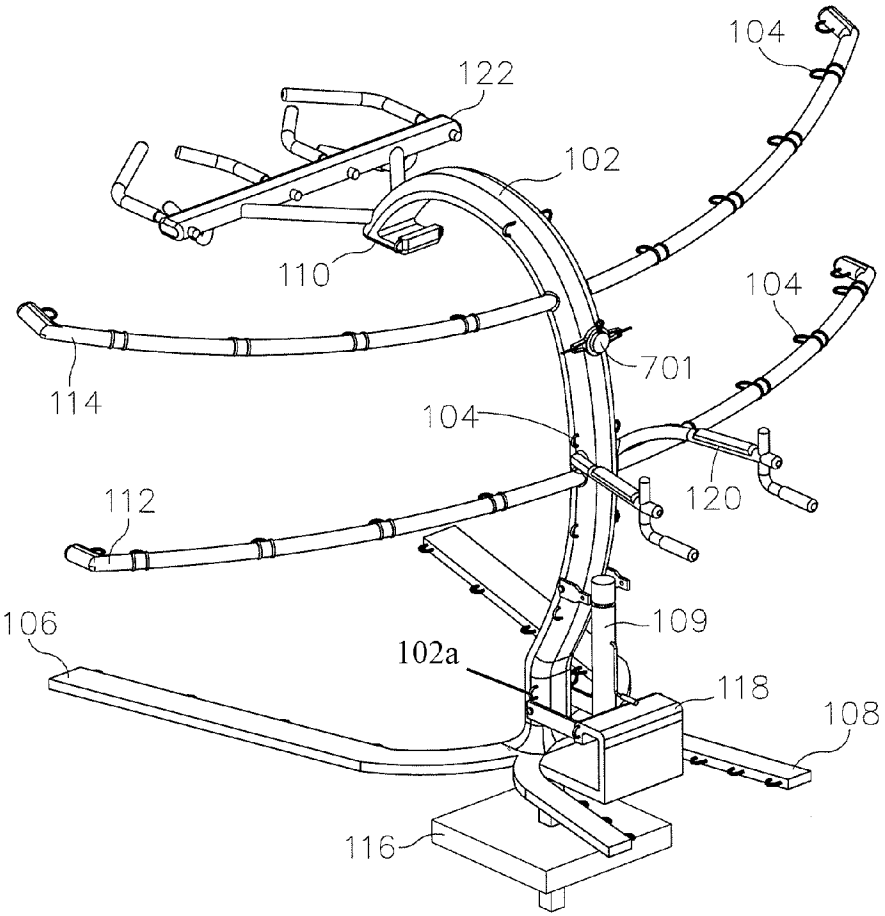
Figure 3:
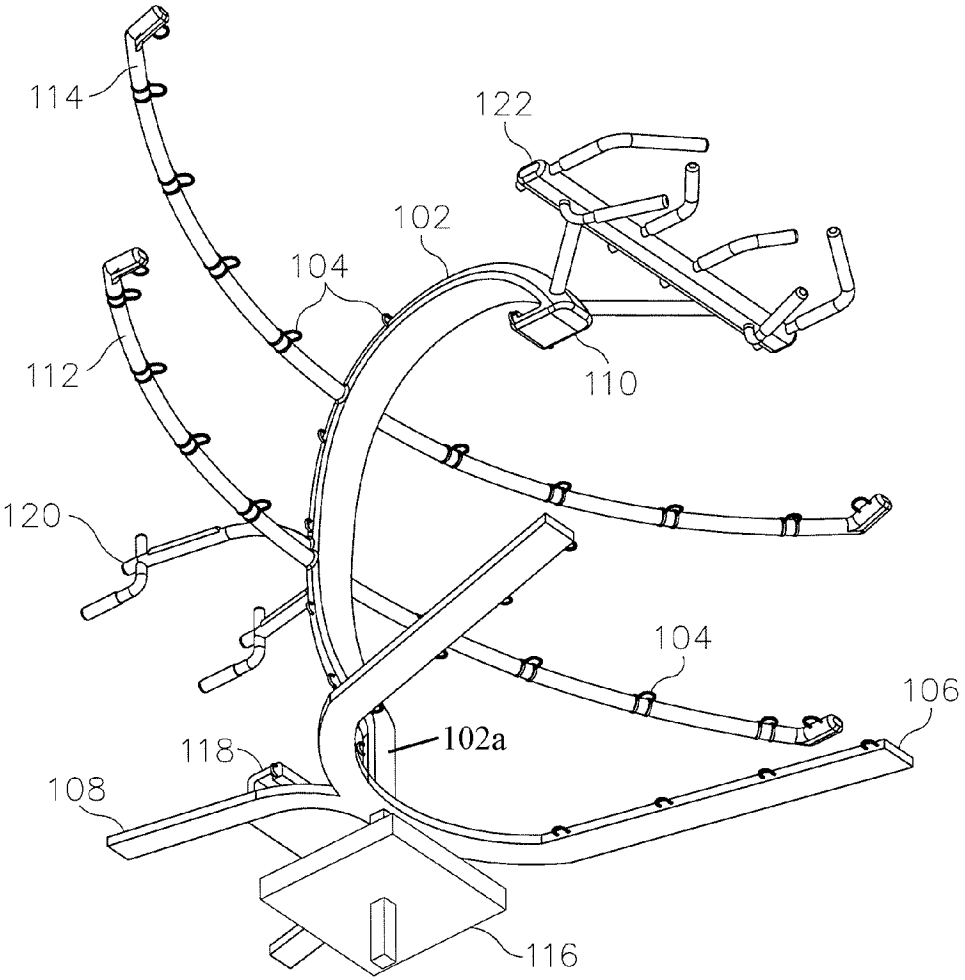
Figure 6:
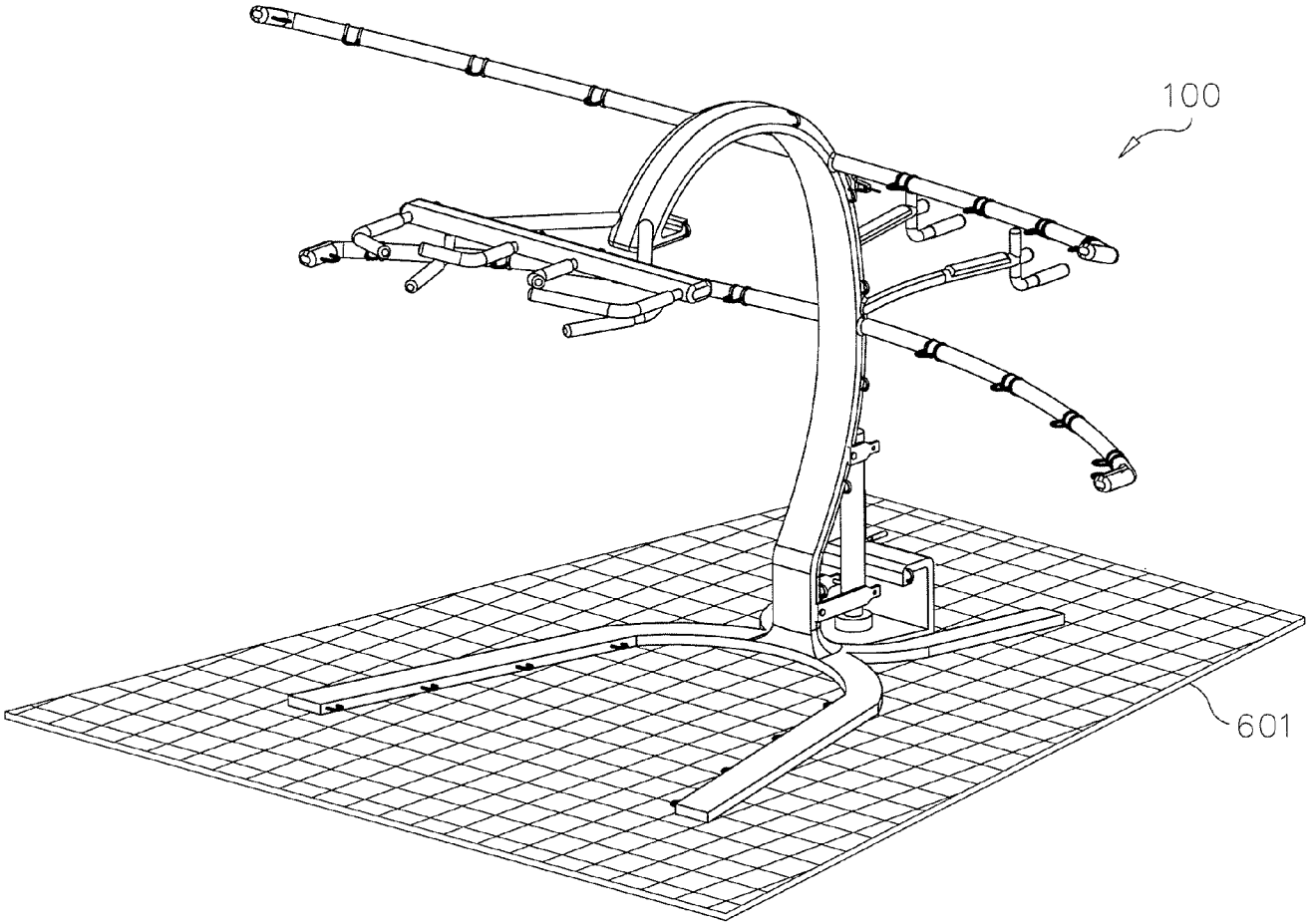
FIG. 6 is a perspective view of a strength training and stretching system including an athletic flooring surface, according to an exemplary embodiment of the present disclosure.

Further, in an exemplary embodiment, the various components of the strength training and stretching system 100 may be fully or partially adjustable. For example, the primary arcuated member 102 may include an adjustment mechanism 109 allowing the height of the primary arcuated member 102 to be adjusted by the user. The adjustment mechanism may be, for example, a hydraulic adjustment mechanism 109 as shown in FIGS. 1 to 2 and 6, however the adjustment mechanism 109 is not limited thereto. When the primary arcuated member 102 includes the adjustment mechanism 109, the primary arcuated member 102 may include a hollow outer portion and an inner portion shaped and dimensioned to fit within the hollow outer portion. The inner portion may slidably move within the hollow outer portion and lock at different positions as the height is adjusted via the adjustment mechanism 109, allowing the user to adjust the height of the primary arcuated member 102. For example, utilization of the adjustment mechanism 109 may allow the height of the primary arcuated member 102 to be adjusted substantially in a vertical direction.

In an exemplary embodiment, the angle and/or arc of the first and/or second ancillary arcuated members 112 and 114 may also be adjustable, allowing the user to adjust the angle and/or arc of the first and/or second ancillary arcuated members 112 and 114 relative to the primary arcuated member 102.

As described above, the strength training and stretching system 100 may be used in an indoor or outdoor environment. In an exemplary embodiment, the strength training and stretching system 100 includes an athletic flooring surface 601, as shown in FIG. 6. The athletic flooring surface 601 provides shock absorption and traction for the user, allowing the user to perform physical exercises using the strength training and stretching system 100 in a safer and more comfortable manner. The athletic flooring surface 601 may be constructed of, for example, rubber, a variety of plastics, etc., and may partially or entirely surround the front and/or rear band legs 106 and 108.

The athletic flooring surface 601 may be formed in a variety of shapes. For example, in an exemplary embodiment, the athletic flooring surface 601 may have a substantially trapezoidal or rectangular shape, forming an exercise footprint in the area(s) on the ground surface 101 at which the user may be located while using the strength training and stretching system 100. The size of the athletic flooring surface 601 may vary depending on the length of the front and rear band legs 106 and 108, as well as the distance between the legs in each pair of the front and rear band legs 106 and 108. For example, relative to the outermost portions of the front and rear band legs 106 and 108, the athletic flooring surface 601 may form a border around the strength training and stretching system 100 of about 1 foot to about 3 feet. In an exemplary embodiment, the athletic flooring surface 601 may extend outward from an end portion of the front band legs 106 in the D2 direction further than from an end portion of the rear band legs 108 in the D4 direction, providing the user with additional space in the D2 direction to perform exercises that do not utilize the strength training and stretching system 100 (e.g., jumping rope, yoga stretching, etc.). The athletic flooring surface 601 may have a thickness between about 0.5 inches and about 2 inches. For example, in an exemplary embodiment, the athletic flooring surface 601 may have a thickness of about ¾ inches.

According to an exemplary embodiment, the athletic flooring surface 601 may include exercise markings visible to the user. The presence of exercise markings provides assistance to the user while the user performs various exercises. For example, in an exemplary embodiment, the athletic flooring surface 601 may include a plurality of subportions, each subportion defining predetermined markings, or including a predefined number of markings disposed at predefined locations. The subportions may be of various shapes, and may have various sizes. For example, each subportion may be in the shape of a square, and may be about 6 inches by 6 inches. The subportions may themselves define certain markings, or markings included in each subportion may be numbers and/or dashes, which can be used by the user to track his or her standing location for a variety of different exercises, as well as progress through a number of different positions corresponding to different difficulty levels for the same exercise. The athletic flooring surface 601 may further include markings indicating the correct location for different exercise equipment including, for example, a BOSU ball, balance disc(s), balance board, exercise ball, exercise bench, etc. The utilization of markings on the athletic flooring surface 601 is not limited to an athletic flooring surface 601 including a plurality of subportions. For example, according to an exemplary embodiment, the athletic flooring surface 601 may not include a plurality of subportions and may include markings. The athletic flooring surface 601 may be utilized with the strength training and stretching system 100 in both an indoor and outdoor setting.

Figure 7B:
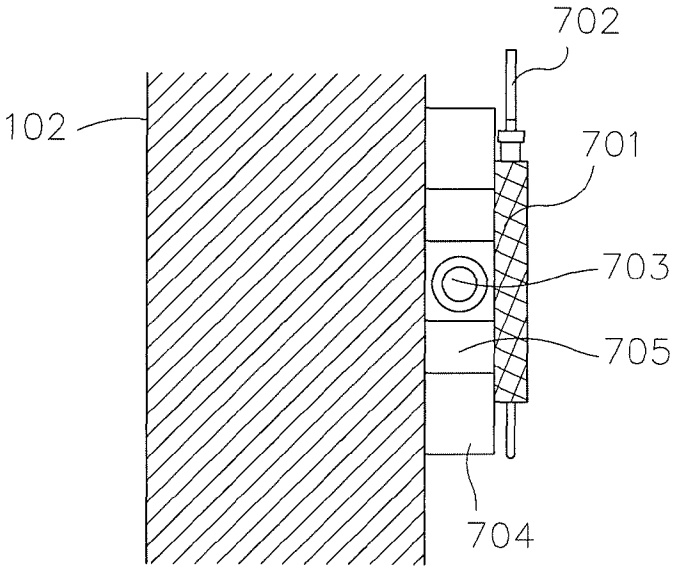
FIGS. 7A to 7B show an auto-centering cleat and auto-centering exercise band, according to an exemplary embodiment of the present disclosure.
Figure 7A:
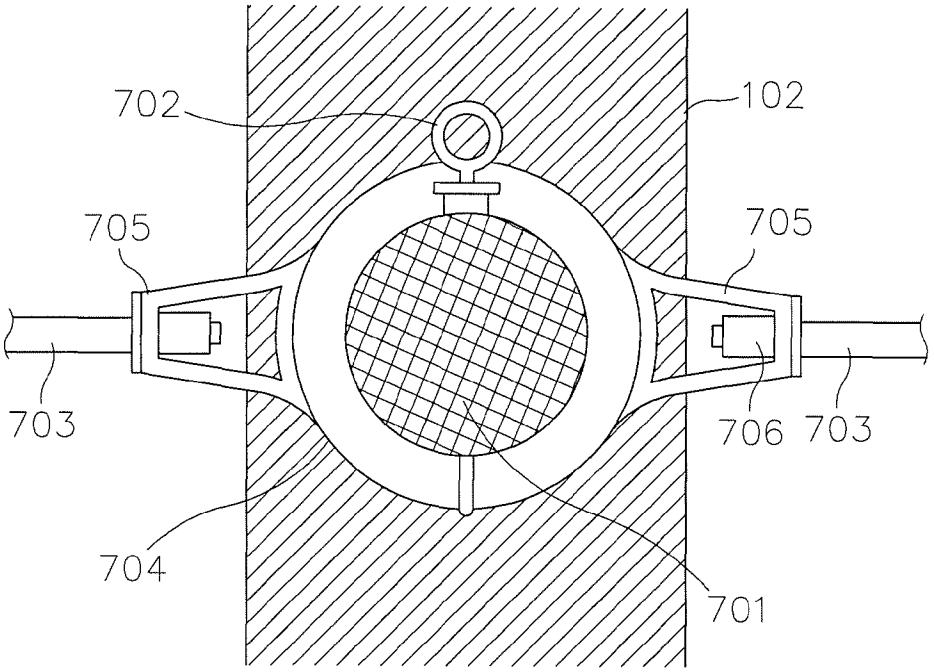

According to an exemplary embodiment, the cleats 104 of the strength training and stretching system 100 may be auto-centering cleats 701 configured to receive auto-centering exercise bands 703, as shown in FIGS. 7A to 7B and 2. The auto-centering cleats 701 may have a height of about 1.5 inches and a diameter of about 3.25 inches, however the dimensions are not limited thereto. The auto-centering cleats 701 may include certain similar features and characteristics of the cleats 104 described herein (e.g., the auto-centering cleats 701 may be disposed at predefined intervals on the arcuated members, may be made of a variety of metals including, for example, steel, may be a separate component welded to the arcuated members or manufactured as part of the arcuated members, etc.), except that in addition, the auto-centering cleats 701 are configured to receive auto-centering exercise bands. For example, as shown in FIGS. 7A and 7B, each auto-centering cleat 701 may include a hole drilled therein for receiving a locking pin 702 to secure an auto-centering exercise band 703 to the auto-centering cleat 701. The locking pin 702 may be composed of a variety of metals including, for example, steel.

An auto-centering exercise band 703 according to an exemplary embodiment is shown in FIGS. 7A and 7B. The center of the auto-centering exercise band 703 may include an O-ring 704. The O-ring 704 may be composed of a variety of metals including, for example, steel, may have a diameter of about 3.30 inches at the opening, and may be about 0.75 inches wide, bringing the outer layer of the O-ring 704 to about 4.80 inches. The left and right sides of the O-ring 704 each include integrated anchor components 705 configured to secure an auto-centering exercise band 703 through a circular hole in the base of each anchor component 705. The circular hole in the base of the anchor component 705 is designed to receive auto-centering exercise bands 703 having various thicknesses and diameters. For example, the anchor component 705 may receive auto-centering exercise bands 703 having a diameter of about 0.25 inches to about 1.0 inches, however the anchor components 705 are not limited thereto. The auto-centering exercise band 703 may then be locked in place with a rubber stopper 706 and a washer at the end of the auto-centering exercise band 703. With the inclusion of the anchor component 705, the auto-centering exercise band 703 may be about 9 inches wide. As a result, the user may use the combination of the auto-centering cleats 701 and the auto-centering exercise bands 703 to perform various exercises involving different tension levels, and eliminate the need for the user to manually find the center of each exercise band to provide equal tension.

Exemplary embodiments may include either the cleats 104, the auto-centering cleats 701, or a combination thereof, as shown, for example, in FIG. 2. Further, the cleats 104 and auto-centering cleats 701 may be disposed on a combination of any or all of the arcuated members, band legs, the suspension member, and/or the plank member, and may be disposed on any of the surfaces of these members, as described above with reference to the cleats 104. Placement of the cleats 104 and/or 701 on any of the components of the strength training and stretching system 100 may be customized based on user preference.

It is to be understood that the pull-up bar member 122, the dip bar member 120, the suspension member 110, and the plank member 118 may be used alone or in combination with exercise bands to perform a variety of exercises, and are not limited to pull-up exercises, dip exercises, plank exercises, etc.

Having described exemplary embodiments for a strength training and stretching system, it is noted that modifications and variations can be made by persons skilled in the art in light of the above teachings. It is therefore to be understood that changes may be made in exemplary embodiments of the invention, which are within the scope and spirit of the invention as defined by the appended claims. Having thus described the invention with the details and particularity required by the patent laws, what is claimed and desired protected by Letters Patent is set forth in the appended claims.

What is claimed is:

1. A fitness station, comprising:

a base oriented horizontally and having an upper surface and a lower surface, where the lower surface is positioned adjacent a ground surface upon which the base rests;

a primary member extending upwardly from the base; wherein the primary member and base together comprise a self-supporting structure; and wherein a first section of the primary member extends upwardly from the base and is straight and substantially vertical and a second section of the primary member extends upwardly and outwardly from the first section and is curved from a proximate first section to a terminal end of the second section;

at least two first attachment points are provided on the primary member, said first attachment points being spaced apart from each other; and wherein each of said first attachment points is adapted to selectively receive an exercise band;

a first ancillary member extending from the primary member, wherein the primary member extends substantially in a first direction from the base and the first ancillary member extends substantially in a second direction from the primary member;

at least two second attachment points are provided on the first ancillary member, wherein the second attachment points are spaced apart from each other, and wherein each of the second attachment points is adapted to selectively receive an exercise band;

a second ancillary member extending from the primary member in substantially the second direction;

at least two third attachment points are provided on the second ancillary member, wherein each of the third attachment points are spaced apart from each other; and wherein each third attachment point is adapted to selectively receive an exercise band;

wherein the second section includes a lower portion proximate the base, an upper portion remote from the base and a middle portion between the upper and lower portions; and wherein the first ancillary member extends from the primary member near the middle portion thereof, the second ancillary member extends from the primary member near the upper portion thereof;

a pull-up bar member extending from the primary member near the upper portion thereof, wherein the pull-up bar member has at least one handle provided thereon; and a dip bar member extending from the primary member near the middle portion thereof.

2. The fitness station of claim 1, wherein the base includes:

a first pair of legs extending horizontally for a distance from a lowermost end of the primary member;

at least two second attachment points provided on the first pair of legs, wherein the second attachment points are spaced apart from each other;

a second pair of legs extending horizontally for a distance from the lowermost end of the primary member; and wherein the first pair of legs extends in a substantially opposite direction to the second pair of legs; and at least two third attachment points provided on the second pair of legs, wherein the third attachment points are spaced apart from each other; and wherein each of the second and third attachment points is adapted to selectively receive an exercise band.

3. The fitness station of claim 2, further comprising:

an athletic flooring surface provided adjacent the lower surface of the base, wherein the athletic flooring surface is comprised of a rubber material or a plastic material.

4. The fitness station of claim 3, wherein the athletic flooring surface extends horizontally outwardly from the first pair of band legs and the second pair of band legs of the base.

5. The fitness station of claim 3, wherein the athletic flooring surface includes a plurality of markings thereon; and wherein each of the plurality of markings is provided at one of a plurality of locations on the flooring surface; and wherein the locations are adapted to correspond to various exercise activities.

6. The fitness station of claim 1, further comprising:

an in-ground anchor extending from the lower surface of the base and adapted to be buried into the ground surface and to thereby secure the base on ground surface.

7. The fitness station of claim 6 where in the in-ground anchor includes:

a post which extends vertically downwardly and outwardly from the lower surface of the base; and a shelf member which is provided on the post and extends horizontally outwardly therefrom; said shelf member being positioned a distance vertically away from the lower surface of the base.

8. The fitness station of claim 7, wherein the shelf member is generally parallel to the lower surface of the base.

9. The fitness station of claim 1, wherein one or more of the primary member, the first ancillary member, and the second ancillary member are arcuate.

10. The fitness station of claim 1, wherein the second direction is substantially perpendicular relative to the primary member and substantially parallel relative to the ground surface upon which the base is adapted to rest, and the second ancillary member extends in a substantially parallel direction relative to the ground surface.

11. The fitness station of claim 1, wherein the dip bar member includes at least one handle provided thereon.

12. The fitness station of claim 1, further comprising:

a C-shaped plank member extending from the primary member near the lower portion thereof, and wherein said plank member is adapted to selectively receive an exercise band.

13. The fitness station of claim 1, further comprising:

a suspension member extending from a top end of the primary member; and wherein the suspension member extends inwardly toward the primary member.

14. The fitness station of claim 1, wherein the primary member has the shape of a question mark when viewed from the side, and the shape of a reversed question mark when viewed from the other side.

15. The fitness station of claim 1, wherein the first ancillary member extends outwardly from the second section of the primary member and is generally parallel to at least a portion of the base.

16. The fitness station of claim 1, wherein the straight first section of the primary member and the curved second section are vertically aligned with each other.

17. A fitness station, comprising:

a base;

a primary member having a lower portion adjacent the base, an upper portion remote from the base and a middle portion between the upper and lower portions; and wherein the lower portion extends vertically upwardly from the base; wherein the middle portion of the primary member extends initially outwardly and rearwardly from the lower portion and then extends inwardly and forwardly, and the primary member then extends downward at the upper portion;

at least two first attachment points are provided on the primary member, said first attachment points being spaced apart from each other and being adapted to selectively receive an exercise band;

a pull-up bar member extending in a front direction from the primary member near the upper portion; and a dip bar member extending in a rear direction from the primary member near the middle portion, and where the rear direction is substantially opposite to the front direction.

18. The fitness station of claim 17, further comprising:

a first ancillary member extending from the primary member;

at least two second attachment points provided on the first ancillary member, said second attachment points being spaced apart from each other;

a second ancillary member extending from the primary member; and at least two third attachment points provided on the second ancillary member, said third attachment points being spaced apart from each other; and wherein each of the second and third attachment points is adapted to selectively receive an exercise band.

19. The fitness station of claim 18, wherein one or more of the primary member, first ancillary member, and second ancillary member is arcuate.

20. The fitness station of claim 17, wherein the base includes:

a first pair of band legs;

at least two second attachment points provided on the first pair of band legs and being spaced a distance apart from each other;

a second pair of band legs; and at least two third attachment points provided on the second pair of band legs and spaced a distance apart from each other; wherein each of the second and third attachment points is adapted to selectively receive an exercise band.

21. A fitness station, comprising:

a base oriented horizontally and having an upper surface and a lower surface, where the lower surface is positioned adjacent a ground surface upon which the base rests;

a primary member extending upwardly from the base; wherein the primary member and base together comprise a self-supporting structure; and wherein a first section of the primary member extends upwardly from the base and is straight and substantially vertical and a second section of the primary member extends upwardly and outwardly from the first section and is curved from a proximate first section to a terminal end of the second section; and at least two first attachment points are provided on the primary member, said first attachment points being spaced apart from each other; and wherein each of said first attachment points is adapted to selectively receive an exercise band;

wherein the second section curves rearwardly away from the first section, then curves upwardly for a distance and then forwardly beyond the first section of the primary member.

22. A fitness station, comprising:

a base oriented horizontally and having an upper surface and a lower surface, where the lower surface is positioned adjacent a ground surface upon which the base rests;

a primary member extending upwardly from the base; wherein the primary member and base together comprise a self-supporting structure; and wherein a first section of the primary member extends upwardly from the base and is straight and substantially vertical and a second section of the primary member extends upwardly and outwardly from the first section and is curved from a proximate first section to a terminal end of the second section;

at least two first attachment points are provided on the primary member, said first attachment points being spaced apart from each other; and wherein each of said first attachment points is adapted to selectively receive an exercise band;

a pull-up bar member extending from the primary member near an upper portion of the primary member, wherein the pull-up bar member has at least one handle provided thereon; and a dip bar member extending from the primary member near a middle portion of the primary member.

* * * * *